US012781958B2

(12) United States Patent
Rutgers et al.

(10) Patent No.: US 12,781,958 B2
(45) Date of Patent: Nov. 3, 2026

(54) MIXING DEVICE FOR A GAS HEATER

(71) Applicant: BDR THERMEA GROUP B.V., Apeldoorn (NL)

(72) Inventors: Job Rutgers, Apeldoorn (NL); Andrea Pisoni, Apeldoorn (NL)

( * ) Notice: Subject to any disclaimer, the term of this patent is extended or adjusted under 35 U.S.C. 154(b) by 452 days.

(21) Appl. No.: 18/281,296

(22) PCT Filed: Mar. 8, 2022

(86) PCT No.: PCT/EP2022/055853
§ 371 (c)(1),
(2) Date: Sep. 10, 2023

(87) PCT Pub. No.: WO2022/189413
PCT Pub. Date: Sep. 15, 2022

(65) Prior Publication Data

US 2024/0151394 A1 May 9, 2024

(30) Foreign Application Priority Data

Mar. 10, 2021 (EP) ..... 21161801

(51) Int. Cl.
*F23D 14/64* (2006.01)

(52) U.S. Cl.
CPC ..... *F23D 14/64* (2013.01); *F23D 2203/007* (2013.01)

(58) Field of Classification Search
CPC ..... F23D 14/60; F23D 14/02; F23N 1/027
See application file for complete search history.

(56) References Cited

U.S. PATENT DOCUMENTS 2,377,497 A * 6/1945 Hopkins ..... F23D 14/02 239/405
4,793,798 A * 12/1988 Sabin ..... F23D 14/22 431/90
4,902,222 A * 2/1990 van Belle ..... F24H 3/0488 431/126

(Continued)

FOREIGN PATENT DOCUMENTS

CN 209524091 U 10/2019
EP 559280 A1 * 9/1993

(Continued)

OTHER PUBLICATIONS

Search Report and Written Opinion of the International Searching Authority (ISA) for PCT Application PCT/EP2022/055853, provided by the European Patent Office on May 24, 2022.

(Continued)

*Primary Examiner* — Jorge A Pereiro

(57) ABSTRACT

The invention relates to a gas heater mixing device for a gas heater, comprising a mixing element for mixing gas and fuel gas, a gas line for supplying gas into a chamber of the mixing element, a fuel gas line for supplying fuel gas into the chamber and a moveable valve body, wherein the valve body is arrangeable between different positions for controlling the mixed gas flow that can flow through an outlet opening of the mixing element. The gas heater mixing device is characterized in that the valve body is formed such that the supply of fuel gas by means of the fuel gas line into the chamber depends on the position of the valve body in the chamber.

19 Claims, 3 Drawing Sheets

(56) References Cited

U.S. PATENT DOCUMENTS

Figure 1:
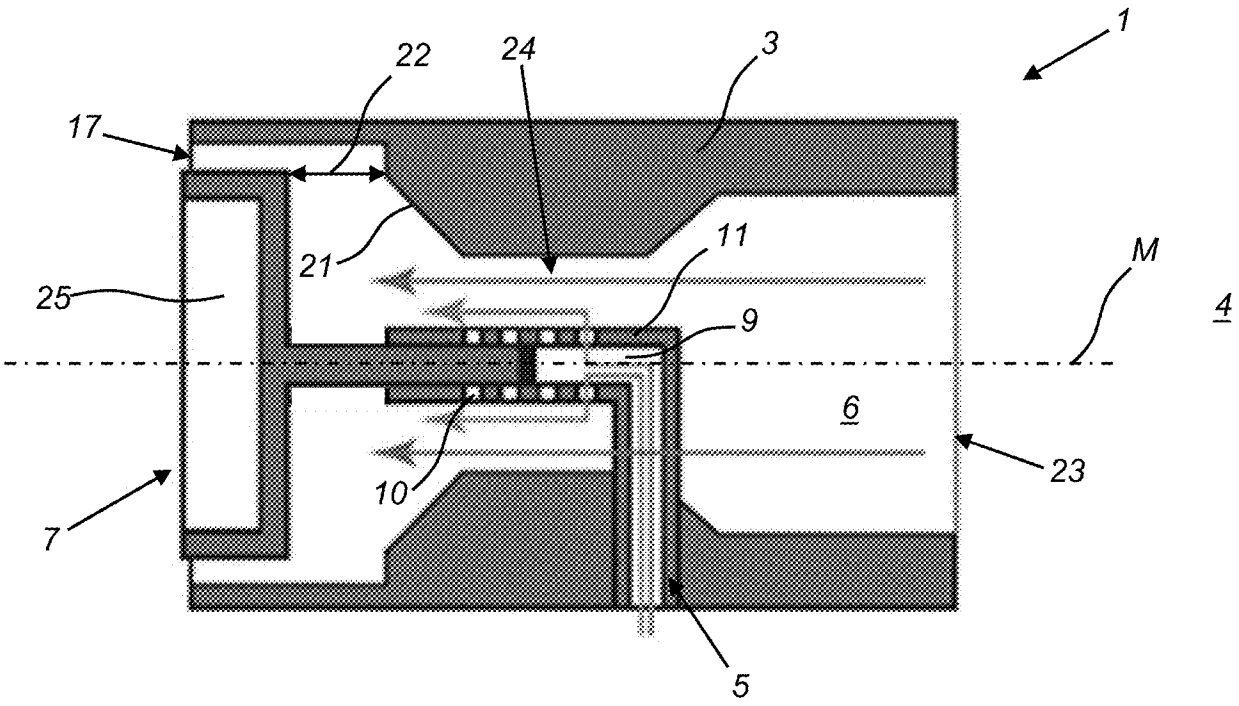

| | | | | | |
|---|---|---|---|---|---|
| 5,240,409 | A * | 8/1993 | Xiong | B01F 25/3131 | 431/189 |
| 6,312,250 | B1 * | 11/2001 | Neville | F23D 14/60 | 431/1 |
| 2018/0231243 | A1 | 8/2018 | Nonoyama | | |

FOREIGN PATENT DOCUMENTS

| | | | | | |
|---|---|---|---|---|---|
| EP | 0702194 | A1 * | 3/1996 | F23D 14/60 | |
| EP | 3662989 | A1 | 6/2020 | | |
| JP | S63297908 | A * | 12/1988 | | |
| WO | WO-2013060997 | A2 * | 5/2013 | F23N 1/027 | |

OTHER PUBLICATIONS

Office Action, Dispatched by CNIPA on Mar. 18, 2026 in Chinese Patent Application No. 202280020102.2 (with machine translation).

* cited by examiner

MIXING DEVICE FOR A GAS HEATER

The invention relates to a mixing device for a gas heater. Additionally, the invention relates to a gas heater with such a mixing device and to a boiler.

A plurality of gas heaters is known from the prior art. A gas heater usually comprises a mixing device comprising a chamber in which gas, in particular air, is mixed with fuel gas. The mixed gas is supplied to a burner of a gas heater. Such gas heaters can for example be used in boilers. The boiler comprises a heat exchanger by means of which water is heated by the gas heater.

In known gas heaters the problem of flashbacks exists. This problem particularly exists when the fuel gas is hydrogen or has a high mol fraction of hydrogen. Flashbacks can lead to a damage of other components of the gas heater, like a fuel gas valve, a fan, etc. Thus, there is the need to suppress flashbacks.

Commonly known mixing device solutions are for example disclosed in EP2664849A2 which is directed to providing a mixing device in accordance with WO 2012/007823 A1 wherein the mixture is not enriched in a transition area and teaches a mixing device comprising a mixing nozzle, particularly a Venturi nozzle, which has two air ducts with a gas supply in each case for guiding the air, and a closure unit, which comprises a flap. The closure unit is formed such that the flap closes the latter air duct or latter gas supply in a closed position during operation with low air mass flow rates. The air speed in the area of the latter gas supply in the transition area between low air mass flow rates and high air mass flow rates is so low that no enrichment of the combustion gas-air mixture takes place. The flap is designed in such a way that the fuel gas-air mixture is not enriched in the transition region; the flap has openings for this purpose. This allows the air to flow through the openings when the flap is partially closed. This prevents high flow velocities from occurring in the area of the second gas supply. The solution disclosed in EP2664849A2, however, does not protect from flashbacks because the air and gas supply are still open to let the flashback pass.

U.S. Pat. No. 2,020,284 473 A2 is directed to reducing alleviating combustion related problems using hydrogen as a fuel gas and discloses a gas heater comprising a valve in order to suppress flashbacks. The valve is arranged upstream of a burner and downstream of a mixing device in which fuel gas and air are mixed. The valve is moveable and can be positioned in an opened position in which the mixed gas flows into the burner. Additionally, the valve can be positioned in a closed positioned when a flashback occurs. In the closed position of the valve, the valve fluidically disconnects the burner from other parts of the gas heater and, thus, prevents that said components are damaged by the flashback.

Design improvement of compressed natural gas (CNG)-Air mixer for diesel dual fuel engines using computational fluid dynamics, Hassan Sadah Muhssen et al., Energy, Volume 216, 1 Feb. 2021, 118957 is directed to examining the performance of existing secondary fuel pre-mixing controllers (SFPMC) and commercial mixer and modifying the design in terms of air to fuel ratio (AFR) and CNG-air mixture homogeneity (CAMH) in view of running internal combustion engine speed. In the document, an SFPMC is disclosed comprising a hollow housing including an air inlet, a CNG entrance, main controller body, mixture outlet part, control valve, spring, plastic washers, and CNG outlet holes. The incoming air passes through the air inlet part and pressing on the control valve against spring force to open the air inlet part and pressing on the control valve against spring force to open the air and CNG pathways, while mixer outlet part discharges the CNG-air mixture to a running engine manifold. The main controlling body contains the housing that supports the axial movement of the control valve and contains the CNG manifold which includes CNG entrance, CNG distribution room and seven CNG outlet holes. The working principle of the mixer is represented by fixing of CNG inlet pressure, while the amount of CNG entering the mixer is controlled by the surface design of a control valve shaft which opens and closes the CNG path during the movement of the control valve. The control valve opens and closes the inner end of the CNG entrance according to the running engine speed and air-fuel ratio requirement. The movement of the control valve depends on the pressure of air that is sucked by the running internal combustion engine and passes through the mixer.

US20110226218A1 is directed to a controller for mixing of a combustible gas or gas mixture including natural gas (CNG), propane, butane, LPG, hydrogen and octane to be used as a secondary fuel mixed fed into the air intake manifold of an internal combustion engine utilized in vehicles such as generators, ships, cranes, airplanes, and helicopters in order to reduce the fuel consumption of the primary fuel which may include octane, diesel, ethanol and kerosene. The document discloses a secondary fuel controller comprising a hollow air inlet threadably engaged with a hollow main controller body at one end thereof, and threadably engaged with an air/fuel mixing outlet. Within the controller are mounted a coaxially aligned air pressure valve positioned in proximity to the inlet end of the air inlet, and a secondary fuel air/air blender positioned in proximity to the outlet end of air/fuel mixing outlet. The valve and air blender are held together by a coaxially aligned connector screw so that the valve and air blender move in unison as a unit within a secondary fuel manifold formed interiorly of the main controller body. An airflow resistance spring is positioned between the air pressure valve and the secondary fuel manifold so as to maintain this arrangement in a closed position wherein, the air blender is seated against an outlet port of the secondary fuel manifold. The secondary fuel manifold includes a transversely oriented secondary fuel inlet which is connectable to a source of secondary fuel such as natural gas (NGV), liquefied petroleum (LPG) and hydrogen. Other fuel sources such as ethanol, biofuel and the like are also envisioned within the scope of this invention. When so connected to the secondary fuel source, pressurized fuel is available within the secondary fuel inlet but will only flow when the air blender is moved to a variable opened position. Opening of the air blender is controlled by inlet air flowing into the air inlet striking against the convex contoured surface of the air pressure valve. The greater the air flow as regulated by engine demand, the greater the opening of the air blender. The secondary or alternate fuel source which enters into the interior of the controller through secondary fuel inlet and then past the air blender will mix within the outlet with the incoming air for discharge from the outlet in a mixed or blended gaseous relationship. This mixed air/secondary fuel mixture will then flow into an air intake manifold of an internal combustion engine for proper blending with the primary fuel source being fed separately into the air intake manifold of the engine.

The object of the invention is to provide a gas heater mixing device in which the components are safe from being damaged by flashbacks, in particular in case hydrogen is used as a fuel, and wherein a compact structure of the gas heater mixing device can be achieved.

The object is solved by a gas heater mixing device comprising a mixing element for mixing gas and fuel gas, a gas line for supplying gas into a chamber of the mixing element, a fuel gas line for supplying fuel gas into the chamber and a moveable valve body, wherein the valve body is arrangeable between different positions for controlling the mixed gas flow that can flow through an outlet opening of the mixing element, characterized in that the valve body is formed such that the supply of fuel gas by means of the fuel gas line into the chamber depends on the position of the valve body in the chamber.

The inventive gas heater mixing device has the advantage that it has a compact structure because the valve body is arranged in the chamber of the mixing element so that less space is required compared to gas heater mixing devices of known gas heaters. Additionally, it can be prevented that components of the gas heater mixing device are damaged by flashbacks.

The mixed gas is the output gas that leaves the gas heater mixing device. The mixed gas can comprise the gas and the fuel gas. Alternatively, the mixed gas can only consist of gas if no fuel gas is inserted into the chamber.

The outlet opening of the mixing element is an opening in the mixing element through which the mixed gas flows in order to be supplied to a burner. The outlet opening can be arranged at one end of the mixing device. An inlet opening of the mixing device is an opening in the mixing element through which gas supplied by for example a fan flows into the chamber of the mixing element. The inlet opening can be arranged at another end of the mixing device. Both openings can be arranged in a respective plane which extends perpendicular to a length axis of the mixing element.

The fuel gas can be a natural gas, methane, ethylene, propane, butane, coal gas, biogas etc., mixtures of the same, and mixtures of the same additionally comprising hydrogen or hydrogen, in particular pure hydrogen. The fuel gas can comprise more than 20 mol % hydrogen. Pure hydrogen is present if the fuel gas has a at least 98 mol % of hydrogen. The gas can be air.

If the gas is air, the gas source corresponds to the surrounding from which a fan sucks air. The fuel gas can be stored in fuel gas tanks or the fuel gas line or fuel gas grid, or be produced in situ such as by an electrolyzer.

In the following, the terms "downstream" and "upstream" refer to a flow direction of the gas from the fan of a gas heater to the burner or to a flow direction of the fuel gas from a fuel gas valve to the burner. The burner can be a pre-mixed burner. Pre-mixed means, that a mixture of the fuel gas and the gas is supplied to the burner.

According to an embodiment of the invention the valve body can close the fuel gas line when the valve is arranged in a first position so that no fuel gas can be supplied into the chamber. In particular, the valve body can close the fuel gas line such that no or limited gas can flow through the outlet opening when the valve is arranged in the first position. Said valve position has the advantage that it increases the safety of the gas heater. In particular, a flashback travel backwards to a fuel gas valve is prevented when the valve body is arranged in the first position.

A fuel gas can be supplied into the chamber when the valve body is not arranged in the first position. In particular, the fuel gas amount that can be supplied into the chamber is dependent on the valve body position. Therefore, it is possible in an easy manner to control the fuel gas amount supplied into the chamber by controlling the valve position. Thus, the composition of the mixed gas can be controlled in an easy way.

The fuel gas line can guide the movement of the valve body from the first position to a second position or vice versa. In particular, a valve shaft can be inserted within a cavity of the fuel gas line. Thus, at least a part of the valve shaft is surrounded by the fuel gas line in a circumferential direction of the valve shaft. In such embodiment an outer diameter of the valve shaft is smaller than an outer diameter of the fuel gas line. In particular, the outer diameter of the valve shaft is slightly smaller than an inner diameter of the fuel gas line so that the valve shaft can move relative to the fuel gas line. The length of protrusion of the valve shaft into the cavity of the fuel gas line depends on the position of the valve body in the chamber.

Alternatively, the moveable valve shaft can surround the fuel gas line in circumferential direction of the valve shaft. In such embodiment the valve shaft is hollow to receipt at least a part of the fuel gas line. Thus, the valve shaft surrounds at least a part of the fuel gas line, in particular the full fuel gas line, in circumferential direction.

In both embodiments the vale shaft can move relative to the fuel gas line wherein the fuel gas line guides the movement of the valve shaft and, thus, the valve body. In particular, the valve body can move in a linear direction. Thus, the valve body can move along the length axis of the mixing element. The valve shaft can have a round cross section. Alternatively, the valve shaft can have different cross sections, in particular a square cross section.

The valve shaft can extend from a valve head of the valve body in a length direction of the mixing element. The valve head can have a greater diameter than the moveable valve shaft. Thus, there is no need to provide a separate guide for the valve because the guide is provided by the fuel gas line that has already to be present in order to supply fuel gas into the chamber. Therefore, a simple structure of the gas heater is achieved.

The fuel gas line can comprise at least one fuel gas opening, such as for example a hole or a slot, in particular several fuel gas openings, through which fuel gas can be supplied into the chamber.

The provision of several fuel gas openings has the advantage that the fuel gas amount supplied into the chamber can be controlled in an easy way by the position of the moveable valve shaft. The fuel gas openings are arranged at a distance from each other, in particular along a length axis of the mixing element. Thus, the supply of fuel gas can be secured via an axial portion of the mixing element so that mixing of fuel gas and air is improved with in the chamber of the mixing element.

The fuel gas opening or each of the fuel gas openings can be arranged such that fuel gas can be supplied into the chamber transversely to a length axis of the mixing element. In particular, the at least one fuel gas opening can be arranged such that the fuel gas is supplied into the chamber along a direction that is perpendicular to the length axis of the mixing element. Such a fuel gas supply shows the advantage that mixing of fuel gas with gas is increased within the chamber of the mixing element. In alternative embodiments the fuel gas can be supplied into a chamber along a direction that has a different angle than 90° to the length axis of the mixing element. It is also possible that the fuel gas is supplied along a tangential direction of the mixing element.

The fuel gas line can be configured such that fuel gas is directed to a radial outward direction when it leaves the fuel gas opening. As radial outward it is understood the direction from the length axis of the mixing element that can be the central axis of the mixing element in a direction away from the length axis. Thus, the fuel gas is not supplied from a wall of the mixing element to the chamber. In said case the fuel gas is directed radial inwards, namely in a direction towards the length axis of the mixing element. The at least one fuel gas opening is arranged such that a movement direction of the valve body differs from a direction of fuel gas when it leaves the fuel gas opening. Such a fuel gas line has the advantage that the fuel gas can be very well mixed with gas flowing in the chamber.

The moveable valve body, in particular the valve shaft, closes the fuel opening or all fuel openings when the valve body is arranged in the first position. In the first position, the valve shaft covers all fuel gas openings so that no fuel gas can flow into the chamber. Thus, it is secured in a compact and safe way that no fuel gas is supplied into the chamber when the valve body is arranged in the first position.

The moveable valve body does not close at least one fuel gas opening when it is arranged in the second position. In particular, in the second position the valve shaft does not close any fuel opening. The valve body can be coupled with the fuel gas line such that the number of fuel openings that are not closed by the valve shaft increase when the valve body moves away from the first position and/or towards the second position. Thus, it is secured that in the second position and/or in an intermediate position between the first position and the second position of the valve fuel gas is supplied into the chamber of the mixing element.

The valve body can be moved in a plurality of positions. The positions differ from each other in the flow area through which the mixture gas can flow. In the first position of the valve, the valve, in particular the valve head, is in contact with a wall of the mixing element and, thus, prevents that mixed gas can flow through the outlet opening of the mixing element. Alternatively, the first position of the valve body is set to allow a predefined gap, also known as a quenching gap, which can remain between the valve head and the wall of the mixing element. Thus, a limited mixed gas flow can occur even though the valve body is arranged in the first position. The gap is designed to ensure that a flame will be extinguished and thus serves as a flame arrester to improve the safety of systems operated with flammable gases or liquid. The quenching gap is defined based at room temperature up to 80-90 degrees Celsius and can be 0.5 and 2.5 mm, in particular in the range of between 0.5 and 1.5 mm. The quenching gap is preferably <0.65 mm for hydrogen applications.

If the valve is in the open position or is moved away from the first position, the flow area corresponds with the area between the wall of the mixing element and the valve, in particular the valve head. In the second position of the valve body, the flow area between the wall of the mixing element and the valve is larger than the flow area when the valve body is arranged in the first position. The mixed gas flow increases with increasing distance between the valve body and mixing element. The maximum mixed gas flow is achieved when the valve body is arranged in the maximum opened position. In said position the valve shaft does not cover any fuel gas opening in the fuel gas line.

According to an embodiment of the invention the fuel gas line can comprise a fuel gas line portion that is arranged coaxial or parallel or tangential or at an angle between 90° and 0° to a length axis of mixing element to the length axis of the mixing element. Alternatively, the fuel gas line can have a different orientation with respect to the length axis of the mixing element. Said fuel gas line portion can comprises the at least one fuel gas opening, the opening can for example be in the form of a hole or slot. In particular, the fuel gas line portion can comprise fuel gas openings that are arranged, in particular diametrical, opposite to each other. The fuel gas line portion has the advantage that the fuel gas can be supplied in a central area of the chamber so that mixing of fuel gas with gas is improved. In particular, the fuel gas line portion can be arranged such that it is surrounded by the chamber. The fuel gas line portion can be surrounded in tangential direction with respect to the length axis of the mixing element. A length axis of the fuel gas line portion is parallel or coaxial to the length axis of the mixing element. As discussed above the length axis of the mixing element can be the central axis of the mixing element.

The chamber can have a symmetrical shape with respect to the length axis. Alternatively, the chamber can have a non-symmetrical shape, in particular, a non-symmetric shape with respect to the length axis. The chamber can have the form of a venturi nozzle. The fuel gas line can be arranged such that the fuel gas can be supplied in an area of the mixing element having the smallest flow cross section in the mixing element. This can be the nozzle portion with constant cross section along the axial extension of the venturi nozzle. Additionally or alternatively the fuel gas can be supplied in an area of the mixing element having a smaller flow cross section than a part of the mixing element downstream and/or upstream of area of the mixing element. The supply of the fuel gas in said area of the mixing element has the advantage that the gas velocity is higher in said area than in other areas of the mixing element. This improves the mixing of fuel gas with gas. Additionally, the venturi nozzle enables that the gas heater can comprise a pneumatic fuel gas valve instead of an electronic or electronical gas valve.

In an advantageous embodiment of the invention a gas heater is provided. The gas heater has a burner that is arranged downstream the mixing device and that is fluidically connected to the mixing device.

The valve can be arranged in the first position when a flashback or other unwanted flue gas flow from the combustion chamber towards the fan occurs. In said situations a pressure upstream the valve body, i.e. on the burner side, is higher than a pressure downstream the valve body, i.e. on the fan side.

Alternatively, the valve can be in the second position or move from the first position to the second position when the pressure at the other end of the mixing device facing away from the burner is higher than the pressure at the end of the mixing device facing the burner.

In an embodiment, the gas heater is configured to use gaseous fuel which comprises 10 mol % to 100 mol %, in particular, 50 mol % to 100 mol %, preferably 95 mol % to 100 mol %, more preferably 95 mol % to 98 mol %, hydrogen. The gas heater according to the invention is not limited to use gaseous fuels comprising hydrogen. Any kind of fuel gas can be used as fuel, e.g. natural gas, methane, ethylene, propane, butane, coal gas, biogas etc. mixtures of the same, and mixtures of the same additionally comprising hydrogen or hydrogen, in particular pure (at least 98 mol %) hydrogen. In this embodiment the gaseous fuel also comprises hydrogen, preferably 95 mol % of hydrogen or more. However, any combination of hydrogen with e.g. natural gas can be used.

The gas heater can comprise the fan for supplying gas to the mixing device. The position of the valve within the chamber, in particular the valve position, can be controlled by the fan of the gas heater. In particular, the valve position depends on the fan power. This is possible because the pressure applied on the valve is dependent on the fan power. The fuel gas valve can be closed and/or the fan can be stopped, when it is detected that the valve body is in the first position. The arrangement of the valve body can be detected by change in the mixture gas flow and/or fan speed.

Additionally, the gas heater comprises a fuel gas valve for controlling the fuel gas supplied into the chamber of the mixing device. The fuel gas valve can be an electronic or electronical gas valve. This can, in particular, be the case when the chamber of the mixture element has not the form of a venturi nozzle. Alternatively, the fuel gas valve can be a pneumatic gas valve. In that case a steering pressure is necessary to open the fuel gas valve.

In a particular advantageous embodiment of the invention a gas boiler for heating water is provided. The gas boiler comprises an inventive gas heater, a heat exchanger with a combustion chamber, wherein the burner of the gas heater is at least partly arranged within the combustion chamber.

In the figures, the subject-matter of the invention is schematically shown, wherein identical or similarly acting elements are usually provided with the same reference signs.

Figure 2:
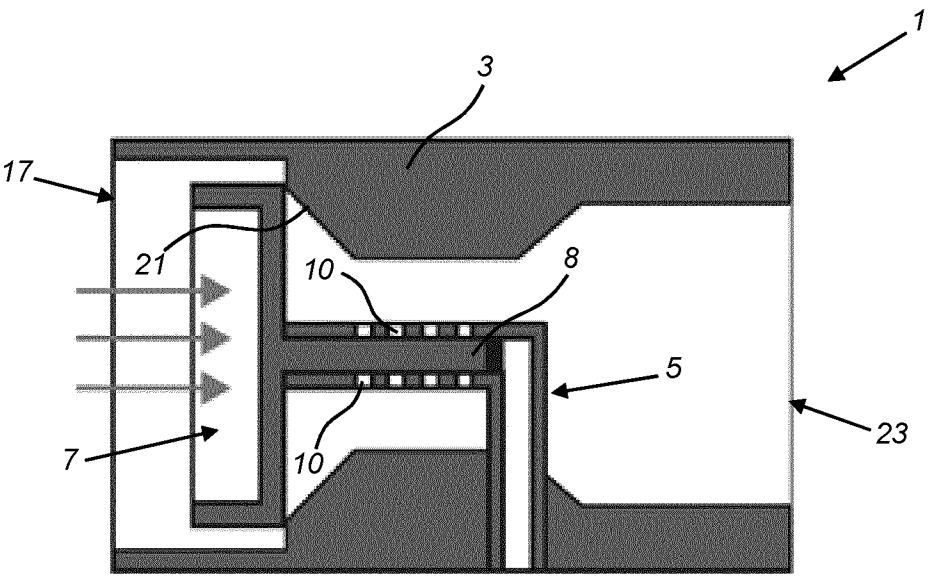
Figure 3:
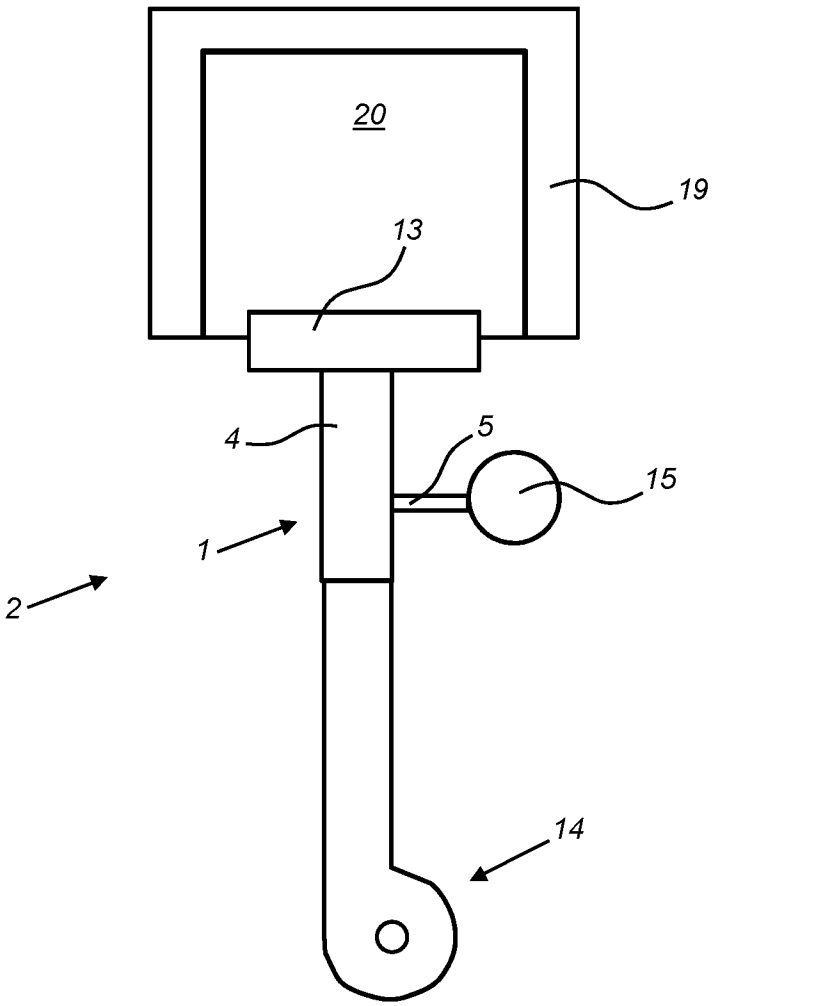

FIG. 1 a side section view of a mixing device according to an embodiment of the invention, wherein a valve is arranged in a second position, FIG. 2 a side section of the mixing device according to the embodiment of the invention, wherein the valve is arranged in a first position, FIG. 3 a schematic view of a gas boiler comprising a mixing device as shown in FIGS. 1 and 2.

A mixing device 1 shown in FIG. 1 comprises a mixing element 3 for mixing fuel gas and gas. Additionally, the mixing device 1 comprises a gas line 4 for supplying gas into a chamber 6 of the mixing element 3. The gas can be ambient air. The mixing device 1 also comprises a fuel gas line for supplying fuel gas into the chamber 6 of the mixing element 3 and a moveable valve body 7. The valve body 7 is arranged within the chamber 6 and can be moved between different positions for controlling the mixed gas flow that can flow through an outlet opening 17 of the mixing element 3. FIG. 1 shows a state of the valve body 7 in which the valve body 7 is arranged in a second position. In said position mixed gas can flow through the outlet opening 17 of the mixing element 3. As is explained below in more detail, the supply of fuel gas by way of the fuel gas line 5 into the chamber 6 of the mixing element 3 depends on the position of the valve 7.

The moveable valve body 7 comprises a valve head 25 and a valve shaft 8 extending from the valve head 25 in a direction. In particular, the valve shaft 8 extends from the valve head 25 such that it is arranged coaxial to a length axis M of the mixing element 3.

In a position shown in FIG. 1, the valve body 7 is not in contact with a wall 21 of the mixing element 3. Thus, a flow area 22 exists between the valve body 7 and the wall 21 in axial direction of the mixing element 3 so that the mixed gas can flow through said flow area 22 towards the outlet 17.

The wall 21 defines at least a part of the chamber 6 along the length axis M of the mixing element 3. An outer cross section of the valve body 7 is smaller than an inner cross section of the chamber 6. This secures that the mixed gas can flow to the outlet opening 17 between the valve body 7 and the wall 21 of the mixing element 3 in radial direction.

The mixing element 3 has an inlet opening 23 through which gas enters the chamber 6. The gas is supplied by the fan 14 shown in FIG. 3. Downstream the inlet opening 23, a part of the chamber 6 is formed as a venturi nozzle 24 in this embodiment. In alternative non-shown embodiments, the chamber does not have a venturi nozzle. The chamber 6 has a portion with a tapering section, a portion with a constant cross section and a widening section.

The fuel gas pipe 5 comprises a fuel gas line portion 11 that extends coaxially to the length axis of the mixing element 3. The fuel gas line portion 11 comprises a plurality of fuel openings 10 that are arranged at a distance to each other along the length axis M of the mixing element 3. Additionally, the holes 10 are arranged such that they are arranged on opposite portions of the fuel gas line portion 11 referring to the length axis M of the mixing element 3.

The valve shaft 8 is arranged within a cavity 9 of the fuel gas line 5. The valve portion 8 protrudes into the cavity 9 to different extents dependent on the position of the valve body 7. In the partly opened position of the valve shown in FIG. 1 the valve shaft 8 enters the hole such that only a part of the holes 10 are covered. In a non-shown opened position of the valve body 7, the valve shaft 8 does not cover any hole 10.

The fuel gas leaves the fuel gas line via the holes 10. The holes 10 and/or the fuel gas line portion are positioned such that the flow direction of the fuel gas when leaving the holes 10 is perpendicular to the flow direction of the gas. After the fuel gas left the holes 10 it is mixed with the gas in the venturi nozzle 24 part of the chamber 6. The mixed gas leaves the mixing device 1 through the outlet opening 17.

FIG. 1 shows a state in which no flashback occurs in a burner 13 shown in FIG. 3. This means, the pressure applied on the valve body 7 from downstream the valve body 7, i.e. from the fan side, is higher than a pressure applied on the valve body 7 from upstream the valve body 7, i.e. from the burner side. The pressure is mainly applied by the mixed gas shown by arrows in FIG. 1.

FIG. 2 shows a side section of the mixing device 1 according to the embodiment of the invention, wherein the valve body 7 is arranged in a first position. In said position the valve body 7, in particular the valve head 25, is in contact with the wall 21 of the mixing element 3. Thus, there is no flow area between the valve 7 and the wall 21 through which the mixed gas could flow. In a non-shown embodiment the valve body 7 is in a close contact with the widening section when the valve body 7 is in the first position and moves towards the outlet opening 17 when it is transferred to the second position. Close contact means that in the close contact position, there remains a predefined gap, also known as a quenching gap. This gap is designed to ensure that a flame will be extinguished and thus serves as a flame arrester to improve the safety of systems operated with flammable gases or liquid. The quenching gap is defined based at room temperature up to 80-90 degrees Celsius and can be 0.5 and 2.5 mm, in particular in the range of between 0.5 and 1.5 mm. The quenching gap is preferably <0.65 mm for hydrogen applications.

As is evident from FIG. 2, the moveable valve shaft 8 protrudes in the cavity 9 of the fuel gas line such that it covers all fuel gas openings 10 of the gas line 5 when the valve body 7 is in the first position. Thus, in the first position, no or hardly any fuel gas can be supplied to the chamber 6 via the fuel gas line 5.

FIG. 2 shows as an example a state in which a flashback occurs in the burner 13 shown in FIG. 3. That means, the pressure applied on the valve body 7 from the burner side is higher than the pressure applied on the valve body 7 from the fan side. Thus, the valve body 7 is pressed against the wall 21 due to the applied pressure. The pressure direction resulted from the flashback is shown by arrows in FIG. 2.

FIG. 3 is a schematic view of a boiler 18 comprising a gas heater 2 with mixing device 1 as shown in FIGS. 1 and 2. The fan 14 of the gas heater 2 is arranged upstream of the mixing device 1 and sucks ambient air. The sucked air flows through the gas line 4 and the inlet opening 23 into the mixing chamber 6. If there is no flashback, the gas is mixed in the mixing chamber 6 with the fuel gas supplied by the fuel gas line 5 and leaves the mixing device 1 via the outlet opening 17.

The gas heater 2 comprises a fuel gas valve 15 which controls the fuel gas amount that is supplied into the chamber 6 of the mixing element 3. Additionally, the gas heater 2 comprises the burner 13 that is arranged downstream the mixing device 1. Thus, the mixed gas outflowing of the mixing device 1 is supplied to the burner 13. The burner 13 is partly arranged within a combustion chamber 20 of the boiler 18. The flue leaves the combustion chamber 20 via a non-shown opening.

The boiler 18 comprises a heat exchanger 19 used for heating a liquid, in particular water, by the heat provided by the burner 13.

REFERENCE SIGNS

1 gas heater mixing device
2 gas heater
3 mixing element
4 gas line
5 fuel gas line
6 chamber
7 valve body
8 valve shaft
9 cavity
10 hole
11 fuel gas line portion
13 burner
14 fan
15 fuel gas valve
17 outlet opening of mixing element
18 boiler
19 heat exchanger
20 combustion chamber
21 wall
22 flow area
23 inlet opining
24 venturi nozzle
25 valve head
M length axis

The invention claimed is:

1. A gas heater mixing device comprising:
a mixing element for mixing gas and fuel gas;
a gas line for supplying gas into a chamber of the mixing element;
a fuel gas line for supplying fuel gas into the chamber; and
a moveable valve body, wherein the valve body is arrangeable between different positions for controlling the mixed gas flow that can flow through an outlet opening of the mixing element;
wherein the valve body is formed such that the supply of fuel gas by means of the fuel gas line into the chamber depends on the position of the valve body in the chamber;
wherein the fuel gas line comprises a plurality of fuel gas openings through which fuel gas can be supplied into the chamber;
wherein the fuel gas openings are arranged at a distance from each other along the length axis of the mixing element;
wherein the valve body closes all of the fuel gas openings if the valve body is arranged in a first position;
wherein the valve body does not close at least one of the fuel gas openings if it is arranged in a second position; and
wherein a number of the fuel gas openings that are not closed by the valve body increases when the valve body moves towards the second position.

2. The gas heater mixing device according to claim 1, wherein the fuel gas line guides the movement of the valve body from a first position to a second position or vice versa.

3. The gas heater mixing device according to claim 1, wherein the valve body comprises a valve shaft that:
a. is inserted within a cavity of the fuel gas line; and/or
b. has an outer diameter that is smaller than an outer diameter of the fuel gas line; and/or
c. is at least partly surrounded by the fuel gas line.

4. The gas heater mixing device according to claim 1, wherein;
the fuel gas line is configured such that fuel gas is directed in a radial outward direction when it leaves the fuel gas openings.

5. The gas heater mixing device according to claim 1, wherein:
the valve body moves in a linear direction.

6. The gas heater mixing device according to claim 1, wherein a fuel gas line portion:
is arranged coaxial, tangential, parallel or at an angle between 90° and 0° to a length axis of the mixing element.

7. The gas heater mixing device according to claim 1, wherein the chamber has a form of a venturi nozzle.

8. The gas heater mixing device according to claim 1, wherein the fuel gas line is arranged such that
fuel gas can be supplied in an area of the mixing element having a smaller flow cross section than a part of the mixing element downstream and/or upstream of the area.

9. A gas heater comprising a gas heater mixing device according to claim 1 and a burner that is arranged downstream of the mixing device and that is fluidically connected with the mixing device.

10. The gas heater according to claim 9, wherein the valve body is arranged in the first position if a pressure at an end of the mixing device facing the burner is higher than a pressure at another end of the mixing device facing away from the burner.

11. The gas heater according to claim 9, wherein the gas heater is configured to use fuel gas which comprises at least 10 mol % hydrogen.

12. The gas heater according to claim 9, wherein:
a. the gas heater comprises a fan for supplying the gas to the gas heater mixing device; and/or
b. the gas heater comprises a fuel gas valve for controlling the fuel gas supplied into the gas heater mixing device.

13. A boiler for heating a liquid, wherein the boiler comprises a gas heater according to claim 9, and a heat exchanger with a combustion chamber, wherein the burner of the gas heater is at least partly arranged within the combustion chamber.

14. The gas heater mixing device according to claim 1, wherein the valve body comprises a valve shaft that extends in a length direction of the mixing element from a head portion of the valve body.

15. The gas heater mixing device according to claim 1, wherein the fuel gas line is arranged such that fuel gas can be supplied in an area of the mixing element having the smallest flow cross section in the mixing element.

16. The gas heater mixing device according to claim 1, wherein a fuel gas line portion is surrounded by the chamber.

17. The gas heater mixing device according to claim 1, wherein the valve body comprises a valve shaft, and wherein a length of protrusion of the valve shaft into a cavity of the fuel gas line depends on a position of the valve body in the chamber.

18. The gas heater mixing device according to claim 1, wherein the fuel gas openings are arranged such that a movement direction of the valve body differs from a direction of fuel gas when it leaves the fuel gas openings.

19. The gas heater mixing device according to claim 1, wherein the fuel gas openings are arranged such that fuel gas can be supplied into the chamber transverse to a length axis of the mixing element.

* * * * *